United States Patent [19]

Epstein

[11] Patent Number: 5,024,175

[45] Date of Patent: Jun. 18, 1991

[54] FLEXIBILITY ENHANCEMENT MULTI-MACHINE CAROUSEL

[76] Inventor: William E. Epstein, Rte. 4, Box 152, Anderson, S.C. 29624

[21] Appl. No.: 436,707

[22] Filed: Nov. 15, 1989

[51] Int. Cl.[5] ..... D05B 75/00; A47B 29/00

[52] U.S. Cl. ..... 112/217.2; 112/217.3; 108/103; 108/142

[58] Field of Search ..... 108/54.1, 103, 104, 108/142; 112/217.1, 217.2, 217.3, 217.4; 211/163; 248/131, 349, 639, 645, 664; 312/252

[56] References Cited

U.S. PATENT DOCUMENTS

| | | | |
|---|---|---|---|
| 584,320 | 6/1897 | Boyd | 108/104 |
| 1,844,664 | 2/1932 | Larson | 108/142 |
| 2,631,909 | 3/1953 | Williams | 108/104 |
| 3,450,080 | 6/1969 | Klose | 112/217.2 |
| 4,229,060 | 10/1980 | Brownlee et al. | 312/252 X |
| 4,237,796 | 12/1980 | Gordon et al. | 108/103 X |
| 4,436,042 | 3/1984 | Hanyu et al. | 112/217.1 |
| 4,450,774 | 5/1984 | Weaver | 108/104 X |

*Primary Examiner*—Werner H. Schroeder
*Assistant Examiner*—Paul C. Lewis
*Attorney, Agent, or Firm*—Cushman, Darby & Cushman

[57] ABSTRACT

The present invention is a multi-machine carousel assembly which supports at least two machines for use at a work station. The invention comprises a base, pivot device, bearing assemblies, and a platform. The base supports the platform by the bearing assemblies and the platform rotates about an axis in common with the base by the pivot device. The platform is rotatable to selectively position any of the machines at a work station. The assembly has a securing device to lock the platform in a desired relation with the base.

19 Claims, 6 Drawing Sheets

FLEXIBILITY ENHANCEMENT MULTI-MACHINE CAROUSEL

BACKGROUND OF THE INVENTION

1. Field of the Invention

This invention relates to a novel work station enhancement carousel for use in the garment manufacturing industry. More specifically, this invention relates to a multi-machine carousel assembly for supporting at least two machines at a work station in a garment unit production or modular system.

2. Description of the Related Art

Garment unit production or modular systems comprise a plurality of work stations, each equipped with a sewing machine and operated by a single individual. Garment pieces are mechanically directed to various work stations depending on the stage of garment production. For example, sleeves are sewn to bodices at one work station and at a second station button holes are fashioned in the bodices. A computer monitors which work stations are undersupplied with garment pieces and which have a surplus. The computer then directs the garment pieces to the various work stations according to the work flow at each station. In such a computerized unit production or modular system, garments are manufactured en masse.

Computerized unit production or modular systems, however, lack efficiency in that oftentimes one operator has to man two work stations in order to balance the work flow. Excess garment pieces at a single work station may disrupt the regular operational process and necessitate that an operator have access to two machines. Further, an operator may require the use of more than one machine if the manufacturing needs of a garment require a different machine for the subsequent stage of manufacture. Moreover, if an operator's machine develops a malfunction rendering the machine inoperable, another machine must be readily available and in close proximity to the operator so as not to disrupt the production process.

In the past, under the above circumstances, operators were forced to move from work station to work station to balance the work flow. This movement required time and also meant that all work stations were not in use at any one time, thereby decreasing maximum possible production. These deficiencies reduce the productivity of prior unit production or modular systems in garment manufacturing facilities and increase production costs.

SUMMARY OF THE INVENTION

The present invention is a multi-machine carousel assembly which supports at least two machines for use at a work station. In one preferred embodiment, the invention comprises a base, pivot device, bearing assemblies, and a platform. The base supports the platform by the bearing assemblies and the platform rotates about a vertical axis in common with the base by the pivot device. Multiple machines are mounted to the platform so that an operator may rotate the platform to selectively position each machine at a work station.

With the foregoing in mind, other objects, features and advantages of the present invention will become more apparent upon consideration of the following description and the appended claims with reference to the accompanying drawings, all of which form part of this specification, wherein like reference numerals designate corresponding parts and various figures.

DETAILED DESCRIPTION

Figure 1:
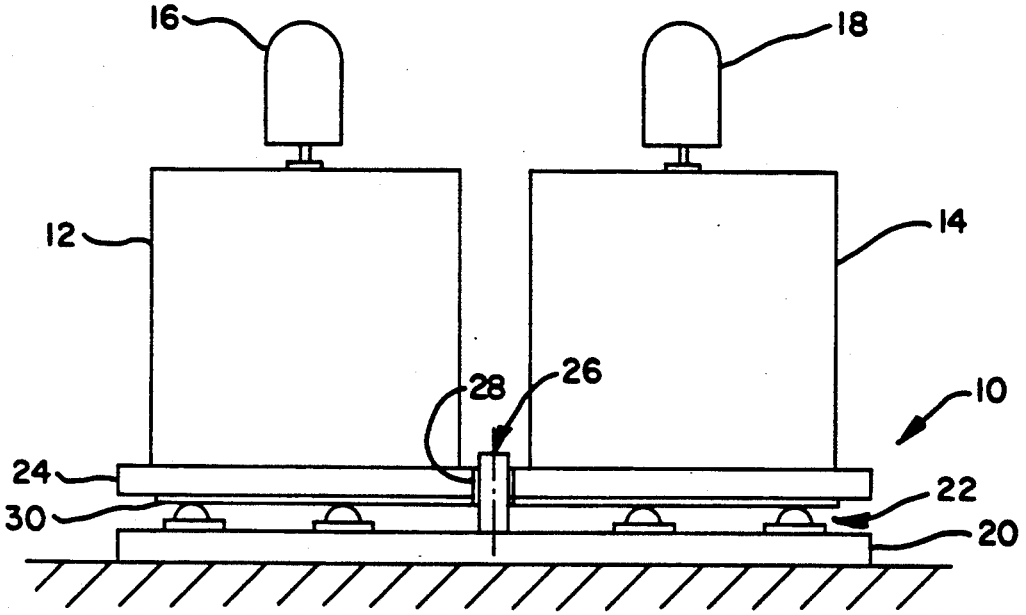
FIG. 1 is an elevational view showing a multi-machine carousel assembly supporting two machines in accordance with a preferred embodiment of the invention.

In FIG. 1, a multi-machine carousel assembly 10 is shown supporting two work benches 12 and 14, benches 12 and 14 including machines 16 and 18, respectively. The multi-machine carousel assembly 10 is operable to rotate at its center to allow an operator to rotate between a primary machine 16 and a secondary machine 18. The machines 16 and 18 may be similar in design and function, or, alternatively, differ in design or function. Moreover, the machines mounted upon the work benches 12 and 14 are not limited to garment manufacturing machines, but may be machines used in other manufacturing facilities operating in a similar manner to garment manufacturing facilities where access to at least two machines at a single work station would prove advantageous in relation to production output.

The multi-machine carousel assembly 10 includes a generally circular base 20 affixed to a ground surface on which a plurality of rollers or wheels 22, such as caged steel balls, are secured. The rollers 22 facilitate movement of a platform 24 with respect to the base 20. The platform 24 is mounted on the rollers 22 and supports two or more benches 12 and 14, each including a separate machine. The platform 24 rotates about an axis in common with the base 20 by a pivot 26. The pivot 26 is mounted upon the base 20 and journals through a central aperture 28 in the platform 24.

The platform 24 can be formed from any suitable material as long as the lower surface 30 of the platform 24 is a smooth, flat surface to allow smooth rotational movement of the platform 24 along the rollers 22. Thus, the lower surface 30 can be separate from the upper surface of platform 24 and is preferably made of metal, hard plastic, wood or other similar material. Alternatively, the lower surface can be integral with the upper surface of the platform 24. Further, the lower surface 30 must have a minimum diameter greater than the outermost placement of rollers 22.

The bench for the primary machine 16 is mounted or disposed above the platform 24 and at one side of an imaginary central line of pivot 26. Diametrically opposite the primary machine 16 is a framework for the secondary or standby machine 18. Alternatively, the platform 24 can support a single framework to which two machines are fixed. The operator occupies a position to prevent unintentional rotation of the carousel assembly 10 and also to control the release of a rotation lock mechanism described more fully below.

Figure 2A:
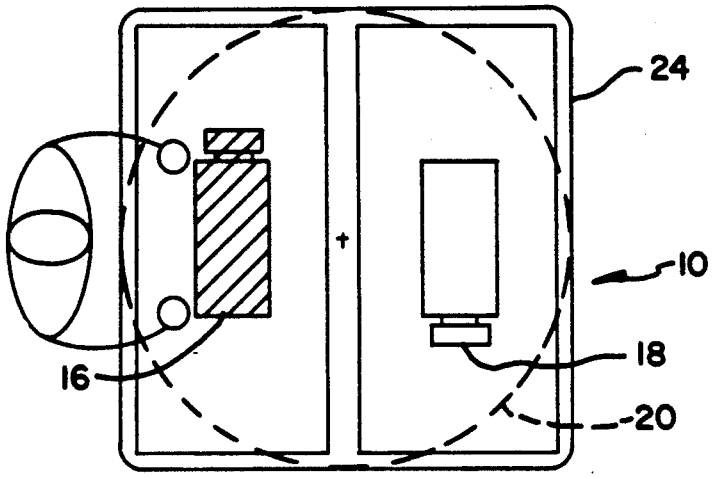
FIGS. 2*a* and 2*b* are top plan views of a multi-machine carousel assembly including a platform and a base showing a 180 degree rotation in accordance with a preferred embodiment of the subject invention.
Figure 2B:
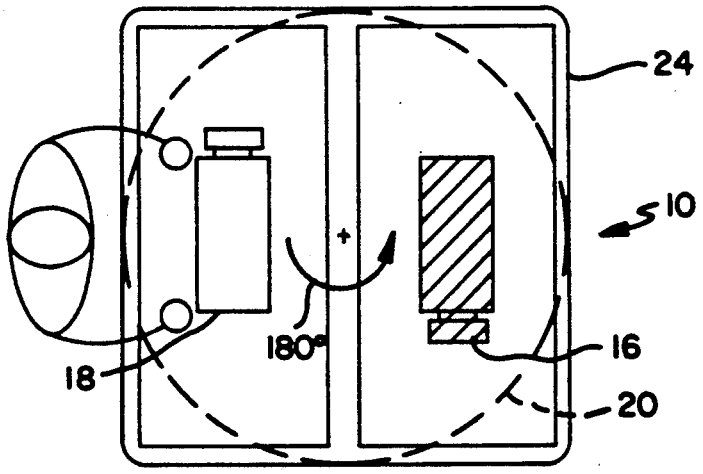
Figure 3:
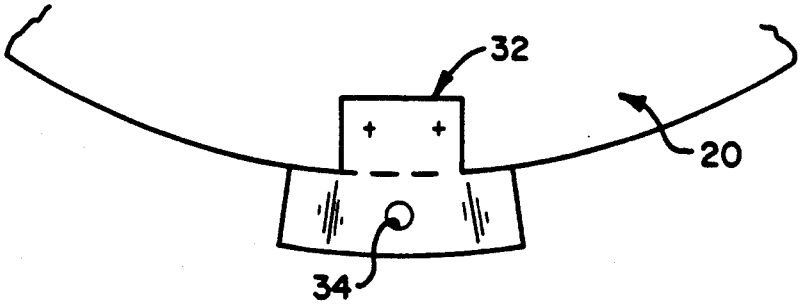
FIG. 3 is a top perspective view of a receiving element located on the periphery of the base of a multi-machine carousel assembly.

FIG. 2*a* shows an operator positioned at a work station with separate frameworks for a primary machine 16, shown shaded, and a secondary machine 18 shown unshaded. The generally circular base 20 is shown by a broken line with a generally square upper platform 24 resting atop the base 20. As shown in FIG. 2*b*, the platform 24 has now been rotated through 180 degrees, with the operator now able to work with the secondary machine 18 also at a convenient and correct position for use by the operator at the work station. Electrical and pneumatic connections (not shown) are conventionally provided on the carousel, to which both machines are connected. This allows either machine to be ready for use at any time. A preferred embodiment of the invention includes a locking mechanism to maintain the desired position of the platform 24 in relation to the base 20.

Figure 4:
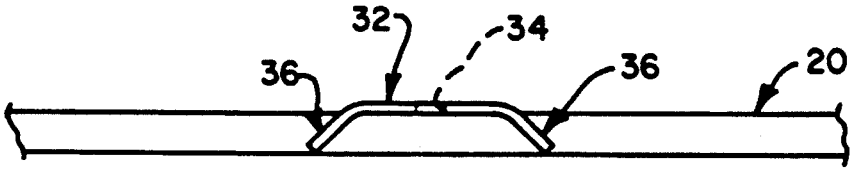
FIG. 4 is a side elevational view of a receiving element located on the periphery of a base of a multi-machine carousel assembly.

One embodiment of the locking mechanism of the multi-machine carousel assembly 10 is shown in FIGS. 3, 4, 5 and 6. More particularly, in FIG. 3, a retaining member 32 is shown mounted at the periphery of the base 20 and is generally located at a point adjacent to where the operator is seated. The retaining member 32 has an aperture 34 operable to receive an extending element of the locking mechanism. As shown in FIG. 4, the rectangular member 32 also has an inclined plane 36 at opposite sides which slope downward to the ground surface at an angle approximately equal to 45 degrees.

Figure 5:
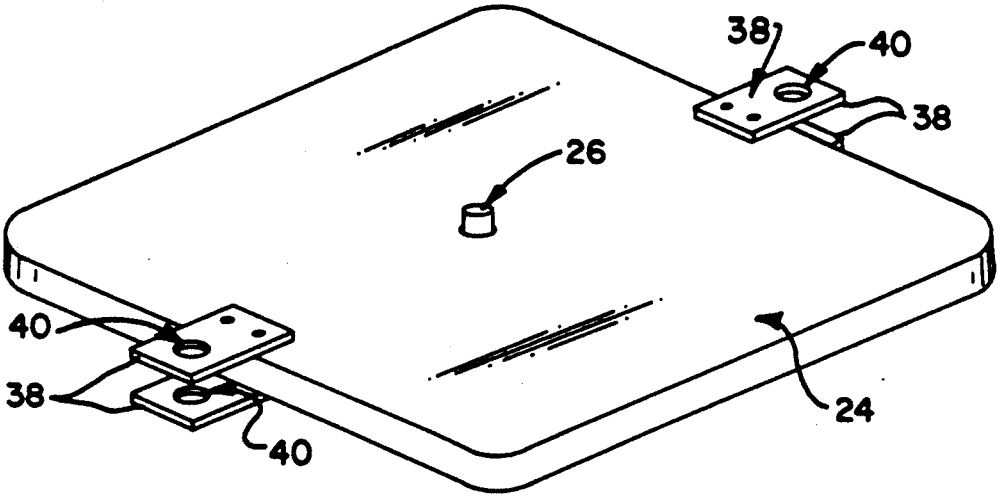
FIG. 5 is a perspective view of a platform of a multi-machine carousel assembly with associated retaining members mounted thereon.

In FIG. 5, two sets of plates 38 are shown mounted to platform 24. Each plate 38 has an aperture 40 of the same diameter as aperture 34 in retaining member 32.

Figure 6:
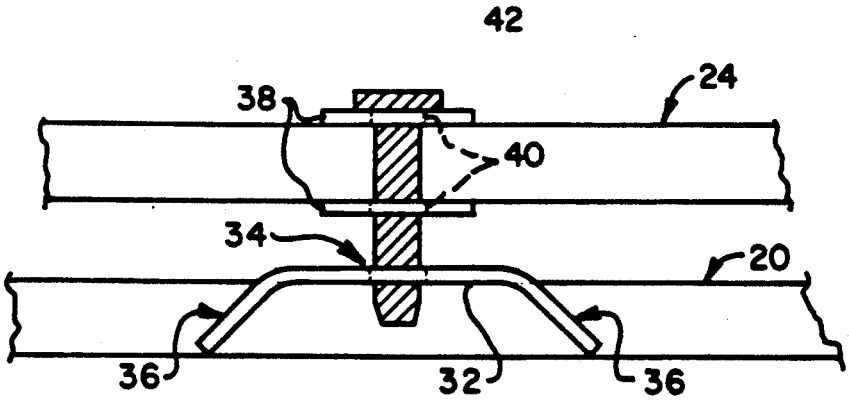
FIG. 6 is a side elevational view of the interaction of a receiving element of a base and an extending element of a platform of a multi-machine carousel assembly.

In FIG. 6, an extending element 42 is shown passing through apertures 40 of one set of plates 38 and engaging with aperture 34 of retaining member 32. In this position, the extending element 42 locks the platform 24 in the desired relation to base 20. The sloped surfaces 36 of retaining member 32 provide a ramp upon which extending element 42 ascends or descends as the platform 24 is rotated to the desired position.

Figure 8:
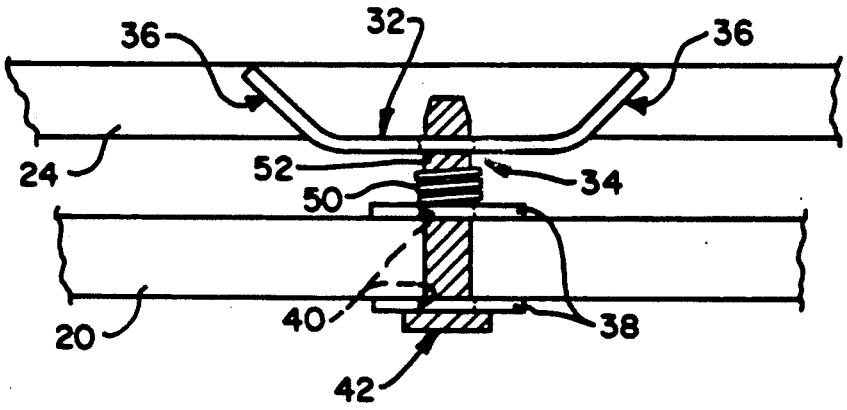
FIG. 8 is a side elevational view of an alternative embodiment locking mechanism.

In one embodiment, extending element 42 is gravity operated and is manually disengaged from retaining member 32. In another embodiment, extending element 42 may be spring operated and manually disengaged. FIG. 8 shows another embodiment where the extending element 42 is spring operated by a spring 50 and a spring retaining pin 52. In FIG. 8 the retaining member 32 is attached to the platform 24 and the extending element 42 is attached to the base 20. This is the reverse situation from that shown in FIG. 6. In another embodiment, extending element 42 may be automatically operated by such means as an electric solenoid or pneumatic cylinder.

Figure 7:
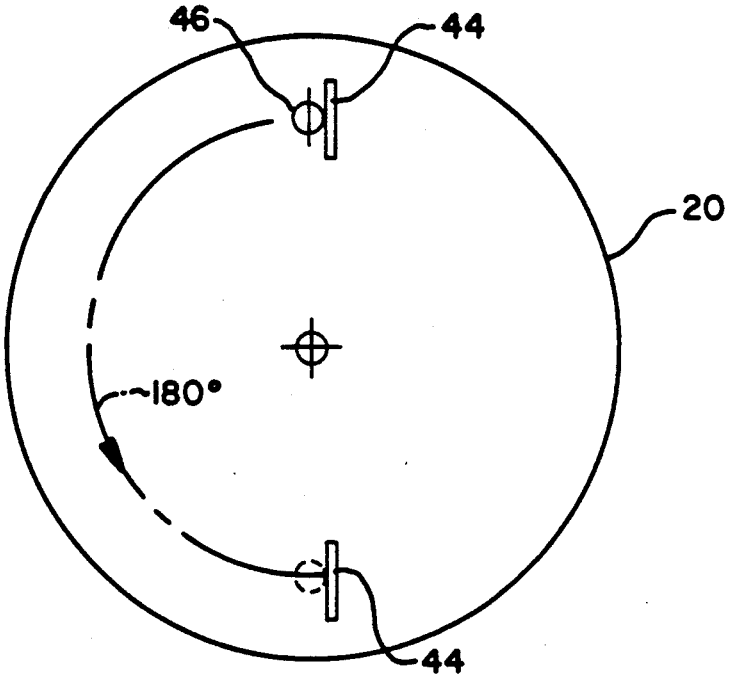
FIG. 7 is a top view of a base of a multi-machine carousel assembly disclosing the locking positions of the carousel in a preferred embodiment of the invention.

In the embodiment of FIG. 7, rotation stops 44 are fitted to the base 20 and acted upon by a peg or other form of stop engaging device 46 fixed to the underside of the rotating platform 24 and provide correct positioning of the platform 24 in relation to the base 20. These rotation stops 44 limit the range of rotation of platform 24 and prevent overrotation.

Thus, in order to place the secondary machine 18 into an operation mode, the operator must simply rotate the multi-machine carousel assembly 10 approximately 180 degrees. It can be desirable for the carousel assembly to support more than two work station machines, in which case the carousel assembly 10 can be constructed having a lock mechanism responsive to a smaller degree of rotation in accordance with the number of work station machines thereon.

While the invention has been described in accordance with what is presently conceived to be the most practical and preferred embodiment, it is to be understood that the invention is not to be limited to the disclosed embodiment but on the contrary, is intended to cover various modifications and equivalent arrangements included within the spirit and the scope of the appended claims, which scope is to be accorded the broadest interpretation of such claims so as to encompass all such equivalent structures.

What is claimed is:

1. A multi-machine carousel assembly for supporting at least two machines and selectively positioning each machine for use at a work station comprising:

a base having an upper surface and a lower surface, the lower surface being supported by a ground surface;

a platform having an upper surface and a lower surface; pivot means for mounting the platform to the base and allowing rotating of the platform about an axis in common with the base;

bearing means for supporting the platform mounted upon the upper surface of the base and engaging the lower surface of the platform;

the platform supporting said at least two machines so that an operator can rotate the platform to selectively position one of said at least two machines in a position adjacent the operator;

at least one receiving member connected to the base including a retaining member having at least one inclined ramp located at an end of the retaining member, the retaining member having an aperture therethrough and being connected to the base; and at least one extending member connected to the platform for selectively interlocking with the receiving member to prevent rotation of the platform; the inclined ramp operably serving to push and guide the extending means toward the aperture of the retaining member.

2. A multi-machine carousel assembly as defined in claim 1 and further comprising at least one additional receiving member allowing the operator to selectively position and lock the platform with respect to the base at more than one position.

3. A multi-machine carousel assembly as defined in claim 1 and further comprising at least one additional extending member allowing the operator to selectively position and lock the platform with respect the base at more than one position.

4. A multi-machine carousel assembly as defined in claim 1 further comprising:

means for disengaging to selectively permit disengagement of the extending member from the receiving member.

5. A multi-machine carousel assembly as defined in claim 1 wherein the inclined ramp of the receiving member comprises:

two mutually opposing, mirror-image inclined ramps located at opposite sides of the retaining member.

6. A multi-machine carousel assembly as defined in claim 1 wherein the extending member comprises:

a pin member operable to extend through the aperture of the receiving means to prevent rotation of the platform with respect to the base, and pin engaging means connected to the platform for operably receiving the pin member.

7. A multi-machine carousel assembly as defined in claim 6 wherein the pin engaging means comprises:

at least one set of plates having two members wherein one of the members is connected to an upper surface of the platform and the other of the members is connected to a lower surface of the platform, each of the members having an aperture for receiving the pin member, the members connected to the platform such that the apertures of the members are in vertical alignment.

8. A multi-machine carousel assembly as defined in claim 1 wherein the lower surface is smooth and contacts the bearing means so that the platform rotates smoothly with respect to the base.

9. A multi-machine carousel assembly as defined in claim 6 wherein:

the pin member is biased in an extended position.

10. A multi-machine carousel assembly for supporting at least two machines and selectively positioning each machine for use at a work station comprising:

a base having an upper surface and a lower surface, the lower surface being supported by a ground surface;

a platform having an upper surface and a lower surface pivot means for mounting the platform to the base and allowing rotating of the platform about an axis in common with the base;

bearing means for supporting the platform mounted upon the upper surface of the base and engaging the lower surface of the platform;

the platform supporting said at least two machines so that an operator can rotate the platform to selectively position one of said at least two machines in a position adjacent the operator; and at least one receiving member connected to the platform, including a retaining member having at least one inclined ramp located at an end of the retaining member, the retaining member having an aperture therethrough and being connected to the platform; and at least one extending member connected to the base, for selectively interlocking with the receiving means to prevent rotation of the platform, the inclined ramp operably serving to push and guide the extending means toward the aperture of the retaining member.

11. A multi-machine carousel assembly as defined in claim 10, and further comprising at least one additional receiving member allowing the operator to selectively position and lock the platform with respect to the base at more than one position.

12. A multi-machine carousel assembly as defined in claim 10, and further comprising at least one additional extending member allowing the operator to selectively position and lock the platform with respect the base at more than one position.

13. A multi-machine carousel assembly as defined in claim 10, further comprising:

means for disengaging to selectively permit disengagement of the extending member from the receiving member.

14. A multi-machine carousel assembly as defined in claim 10, wherein the inclined ramp of the receiving member comprises:

two mutually opposing, mirror-image inclined ramps located at opposite sides of the retaining member.

15. A multi-machine carousel assembly as defined in claim 10, wherein the extending member comprises:

a pin member operable to extend through the aperture of the receiving member to prevent rotation of the platform with respect to the base, and pin engaging means connected to the base for operably receiving the pin member.

16. A multi-machine carousel assembly as defined in claim 15, wherein the pin engaging means comprises:

at least one set of plates having two members wherein one of the members is connected to an upper surface of the base and the other of the members is connected to a lower surface of the base, each of the members having an aperture for receiving the pin member, the members connected to the base such that the apertures of the members are in vertical alignment.

17. A multi-machine carousel assembly as defined in claim 10, wherein the lower surface is smooth and contacts the bearing means so that the platform rotates smoothly with respect to the base.

18. A multi-machine carousel assembly as defined in claim 15, wherein:

the pin member is biased in an extended position.

19. A multi-machine carousel assembly comprising:

a base;

a platform rotatably mounted to said base with bearing means supporting said platform to ease rotation being positioned therebetween, said platform supporting at least two machines so that an operator can rotate the platform to selectively position one of said machines in a position adjacent the operator;

means for securing the platform in a selected position including a first member secured to said base, a second member secured to said platform and an extending element operatively connected to one of said first and second members, the other of said first and second members including means defining an aperture for receiving therein said extending element and an exterior surface having at least one inclined ramp for intersecting with said extending element for operatively lifting and guiding said extending element toward said aperture.

* * * * *